US005279389A

United States Patent [19]

Crockett

[11] Patent Number: 5,279,389

[45] Date of Patent: Jan. 18, 1994

[54] LADDER SUPPORT FOR FLAT-ROOFED BUILDING

[76] Inventor: Robert A. Crockett, 256 12th Ave., Longwood, Fla. 32750

[21] Appl. No.: 894,914

[22] Filed: Jun. 8, 1992

[51] Int. Cl.[5] ..... E06C 7/00

[52] U.S. Cl. ..... 182/129; 182/214

[58] Field of Search ..... 182/129, 229, 214, 107, 182/108

[56] References Cited

U.S. PATENT DOCUMENTS

| | | | |
|---|---|---|---|
| 1,096,903 | 5/1914 | Graham | 182/214 X |
| 2,311,070 | 2/1943 | Morando | 227/8 |
| 2,327,317 | 8/1943 | Randall | 182/214 |
| 2,459,621 | 1/1949 | Cobb | 248/210 |
| 3,115,211 | 12/1963 | Ostrander | 182/103 |
| 4,121,692 | 10/1978 | Morawski | 182/129 |
| 4,598,795 | 7/1986 | Larson | 182/129 X |
| 4,823,912 | 4/1989 | Gould et al. | 182/214 |
| 5,010,979 | 4/1991 | Shreve III | 182/214 |
| 5,139,108 | 8/1992 | Pate | 182/214 X |

FOREIGN PATENT DOCUMENTS

| | | | |
|---|---|---|---|
| 128449 | 6/1919 | United Kingdom | 182/108 |
| 2161528 | 1/1986 | United Kingdom | 182/107 |

*Primary Examiner*—Karen J. Chotkowski

*Attorney, Agent, or Firm*—Michael K. Gray

[57] ABSTRACT

An attachable ladder support for use on flat-roofed buildings in conjunction with a ladder and winch. The ladder support has a contact member for contacting the flat roof of a building. Connected to the contact member are two connecting members which are attached to the contact member in such a manner that a hoisting space is created between the two connecting members. Each connecting member is provided with an insertable end for insertion into a tubular ladder rung. When used in conjunction with a ladder and a winch, the ladder support makes it possible to hoist heavy loads up to a flat roof of a building.

18 Claims, 3 Drawing Sheets

LADDER SUPPORT FOR FLAT-ROOFED BUILDING

FIELD OF THE INVENTION

The present invention generally relates to ladders and ladder supports. More particularly, the present invention pertains to a ladder-attachable ladder support for use on flat-roofed buildings in conjunction with a ladder and a winch. The ladder support of the present invention is easily attachable to a conventional ladder and when used in conjunction with a winch makes it possible for a single individual to hoist heavy loads to a flat roof of a building.

BACKGROUND OF THE INVENTION

The prior art demonstrates a number of props and supports for a ladder mechanism. U.S. Pat. No. 4,598,795 to Larson discloses a boom and prop combination for a ladder to aid in supporting the ladder to a building. The prop is attachable to the rungs of the ladder by means of feet or hooks which are snap-fitted over the rungs of the ladder. A boom is connectable to the rungs of the ladder and is used to support a winch or hoist. A cause for concern in the ladder-hoist attachment of the Larson patent is the snap fit of the supporting prop to the ladder rungs. In that the feet or hooks of the prop are snap-fitted over the rungs of the ladder, a possibility exists for the prop to be dislocated from the ladder, should the ladder or prop be jarred in an upward manner.

U.S. Pat. No. 4,121,692 to Morawski discloses a ladder tray which is boltably attachable to a ladder for supporting a ladder against a building wall.

The prior art demonstrates a number of ladder hoist mechanisms for purposes of hoisting loads to an upward location. Some examples of ladder hoist mechanism are depicted in U.S. Pat. No. 2,459,621 to Cobb and U.S. Pat. No. 2,311,070 to Morando. U.S. Pat. No. 3,115,211 to Ostrander. Jr. discloses a ladder hoist which is powered by an electric motor.

However, none of the above references discloses an economical and easily assembled, secure ladder support which can be used in conjunction with a winch mechanism for lifting heavy loads to a roof top.

Many commercial buildings as well as many residences have flat roofs. A great many of these buildings and residences are three stories high or less so that access is only afforded by means of a conventional ladder or a conventional extension ladder. Roof-access elevators are rare in buildings which are three-stories or less in height. On many commercial buildings, heating and air conditioning units are often placed on a flat roof. These roof-situated units can present a dilemma for service and repairmen when heavy parts or objects need to be brought to the roof.

In FIG. 1, a repairman 2 is climbing a ladder 4 which is propped against a flat-roofed building 6. The repairman in using one hand to carry a large object 8 up the ladder 4 has only one hand to hold on to the ladder 4. Such a prior art method of lifting a large or heavy object to a roof top has many inherent dangers. In that only one hand is used for climbing the ladder 4, as the repairman goes up each rung of the ladder, there are times when the repairman does not have any hands in contact with the ladder at all. Thus, the repairman is totally dependent upon a proper positioning of his feet and torso for balance. Furthermore, in that the repairman is carrying an object with one hand on his one side, such a practice makes it nearly impossible or at least extremely difficult to carry objects weighing more than 100 pounds. The unbalanced nature of carrying an object with one hand up a ladder invites an accident, with an accident becoming more likely the heavier the object carried up the ladder is.

Many objects which are required for repair purposes at the rooftop level are too heavy to carry by hand. For example, many air conditioning compressors weigh as much as 300 pounds or more. When a heavy object is needed to be brought to the rooftop, the repairman will have to call for a crane to assist in placing a desired object on the roof. Being dependent upon a crane is often time-consuming in that much time can be spent waiting for the arrival of a crane and crane operator.

Presently, there are many commercial-use ladders and extension ladders on the market which are made of aluminum or fiberglass and which are provided with tubular rungs which extend from one side of the ladder to the other. Access to the tubular cavities of the rungs is provided on either side of such ladders. In that many ladders available today are fabricated and equipped with tubular rungs, a need is seen for an attachable ladder support, which can be securely fitted into the tubular cavity of a ladder rung, which when used in conjunction with a winch mechanism provides a quick and economical means to lift heavy objects to a rooftop.

SUMMARY OF THE INVENTION

Accordingly, one object of the present invention is to provide a ladder support which is easily attachable to a conventional ladder and which can be used to support the ladder against a flat roof top so as to enable a winch assembly attached to the ladder to lift a heavy load to the roof.

Still another object of the present invention is to provide a ladder support which is safe, economical, and easily assembled on a job site.

Yet another object of the present invention is to provide a ladder support which will enable a single workman to lift a heavy object to a rooftop in a safe and simple fashion so as to increase productivity by increasing the number of jobs which the workman can perform in a single day.

These and other valuable objects and advantages of the present invention are provided by a ladder support for use on a flat-roofed building in conjunction with a conventional ladder and winch. The ladder support has a building contact member having a roof-contact region and a wall-contact region which form a right angle. A first insertable connecting member is connectable to the building contact member. A second insertable connecting member is connectable to the building contact member in such a manner that a hoisting space is created between the first insertable connecting member and the second insertable connecting member. The first insertable connecting member has an insertable end for inserting into a ladder rung cavity and the second insertable connecting member has an insertable end for inserting into the same ladder rung cavity at an opposite side of the ladder.

A first stop bolt is connected to the insertable end of the first insertable member and a second stop bolt is connected to the insertable end of the second insertable member. A first bar support is connectable to a connecting end of the first insertable connecting member. The first bar support is connectable to a first lateral end of the building contact member. A second bar support is connectable to a connecting end of the second insertable member. The second bar support is connectable to a second lateral end of the building contact member. The building contact member, the first insertable connecting member, the second insertable connecting member, the first bar support, and the second bar support are provided with appropriately placed holes so that the building contact member and the first and second insertable connecting members are firmly and boltably attached to each other, with the first and second bar supports providing structural stability to the ladder support.

The ladder support of the present invention is for use with a ladder having a plurality of tubular rungs which are shaped so as to be able to accommodate and secure the insertable end of the first insertable connecting member and an insertable end of the second insertable connecting member in such a manner that when the building contact member is in contact with a flat roof of a building, the first insertable connecting member and the second insertable connecting member are substantially parallel to the ground or surface upon which the ladder is based.

For hoisting materials to a flat roof top, a winch assembly can be connected to the ladder at a rung positioned above the ladder support of the present invention. The ladder support of the present invention is an economical and easily attachable device which will solve many problems encountered by individuals who wish to lift a heavy object to the top of a flat-roofed building.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

When referring to the drawings, like reference numerals designate identical or a corresponding parts throughout the respective figures.

DETAILED DESCRIPTION OF THE INVENTION

Figure 2:
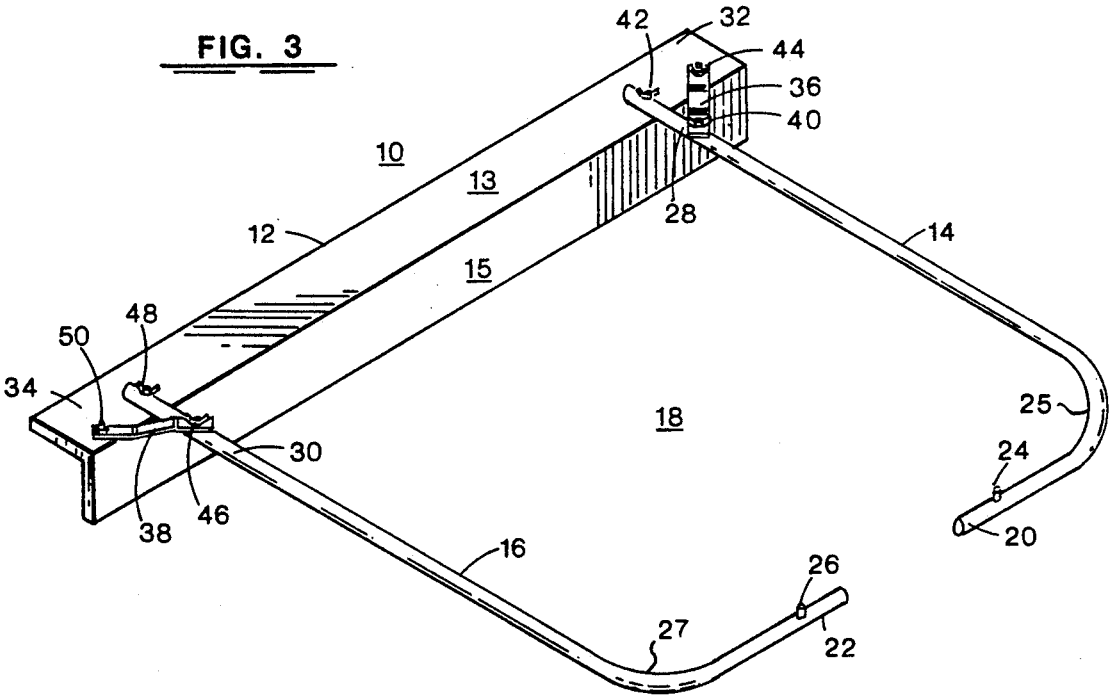
FIG. 2 is a perspective illustration of the ladder support of the present invention.

With reference to FIG. 2, a perspective view of the ladder support 10 of the present invention illustrates a building contact member 12. The building contact member 12 has a roof-contact region 13 and a wall-contact region 15 which form a right angle for purposes of making contact with a flat roof and exterior wall of a building. In the prototype of the present invention, the roof contact region 13 and the wall contact region 15 form an integral 4"×4"×¼" angle (Spec. 6061 T-6) made of aircraft aluminum.

The building contact member 12 is connected to an insertable connecting member 14 and an insertable connecting member 16. A hoisting space 18 is positioned between the insertable connecting member 14 and the insertable connecting member 16. The insertable connecting member 14 is provided with an insertable end 20 for insertion to a ladder rung opening of a side of a ladder. The insertable connecting member 16 is provided with an insertable end 22 for insertion into a ladder rung opening on the same ladder rung to which the insertable end 20 is to be connected. A bending elbow 27 of insertable connecting member 16 forms insertable end 22, and a bending elbow 25 of insertable connecting member 14 forms insertable end 20. In the prototype of the present invention, insertable connecting members 14 and 16 were made of 1" O.D. 304 marine grade stainless steel tubing having 1/16" wall thickness, tig welded, polished and buffed. The tubing which constitutes connecting members 14 and 16 is bent to form the insertable ends 20 and 22. As is demonstrated in FIG. 2, connecting members 14 and 16 are substantially perpendicular to wall contact region 15 of building contact member 12.

A stop bolt 24 is provided on the insertable end 20 and a stop bolt 26 is provided on the insertable end 22. These stop bolts 24 and 26 are for the purpose of preventing movement of the insertable ends 20 and 22. When the insertable ends 20 and 22 are inserted into opposite ends of a ladder rung and the ladder support 10 is properly installed to the ladder into which the insertable ends 20 and 22 are inserted, stop bolt 24 prevents movement of the ladder support in the direction of stop bolt 26 and stop bolt 26 prevents movement of the ladder support in the direction of stop bolt 24.

Still with reference to FIG. 2, insertable connecting member 14 has a connecting end 28 and insertable connecting member 16 has a connecting end 30. Connecting ends 28 and 30 are in perpendicular relation to wall contact region 15 such that insertable connecting members 14 and 16 are in mirror-image relation to one another. Connecting end 28 is attachable to lateral end 32 of roof-contact region 13 of building contact member 12 and connecting end 30 of insertable connecting member 16 is attachable to lateral end 34 of roof-contact region 13 of building contact member 12. Bolts (not shown) are provided in the connecting ends 28 and 30 and in the lateral ends 32 and 34 which correspond to bolted connection points 42 and 48. Bolts, washers, and wing nuts are provided at bolted connection points 42 and 48 to provide a secure connection of the insertable connecting members 14 and 16 to the contact member 12. All bolts, washers and wingnuts used in the prototype of the present invention were made of stainless steel, with the bolts being of 5/16" diameter.

Ladder support 10 of the present invention is further provided with a bar support 36 and a bar support 38 which in the prototype of the present invention were each made of a 1"×¼"×10" aluminum brace. Bar support 36 is attachable to the lateral end 32 of building contact member 12 and to the connecting end 28 of the insertable connecting member 14. Bar support 38 is attachable to the connecting end 30 of insertable connecting member 16 and to the lateral end 34 of building contact member 12. Bolted connection point 40 and bolted connection point 44 connect bar support 36 to the connecting end 28 and the lateral end 32, respectively. Bolted connection point 46 and bolted connection point 50 indicate the point at which the bar support 38 is connected to the connecting end 30 and the lateral end 34, respectively. Each bolted connection point is provided with bolt, washer, and wingnut to securely fasten the bar support to the respective connecting ends of the building contact member 12. Further, the holes (not shown) in the building contact member 12 at connection points 42, 44, 48, and 50 are provided with bronze bushings (the prototype of the present invention was provided with ⅜" O.D.×5/16" I.D. bronze bushings).

Thus, before the ladder support 10 of the present invention is used in conjunction with a winch to lift an object to a rooftop, the building contact member 12, the insertable connection members 14 and 16 and the bar supports 36 and 38 are securely connected at bolted connection points 40, 42, 44, 46, 48 and 50, and the insertable ends 20 and 22 are positioned inside the cavity of a ladder rung. The actual operation of the ladder support 10 of the present invention shall be elaborated upon in subsequent commentary.

Figure 1:
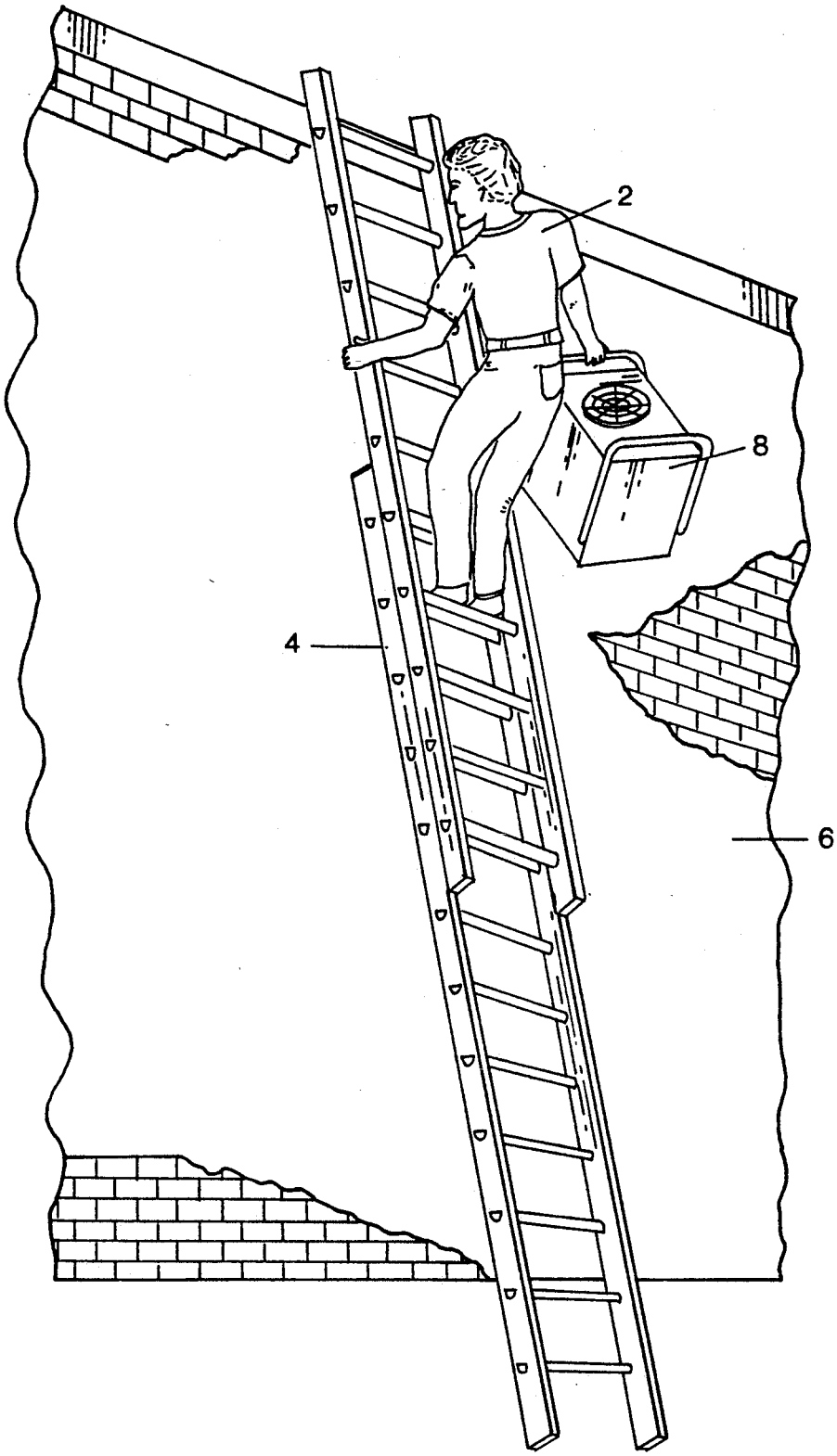
FIG. 1 [PRIOR ART]
FIG. 1 illustrates a prior art method of lifting a heavy object to a rooftop.
Figure 3:
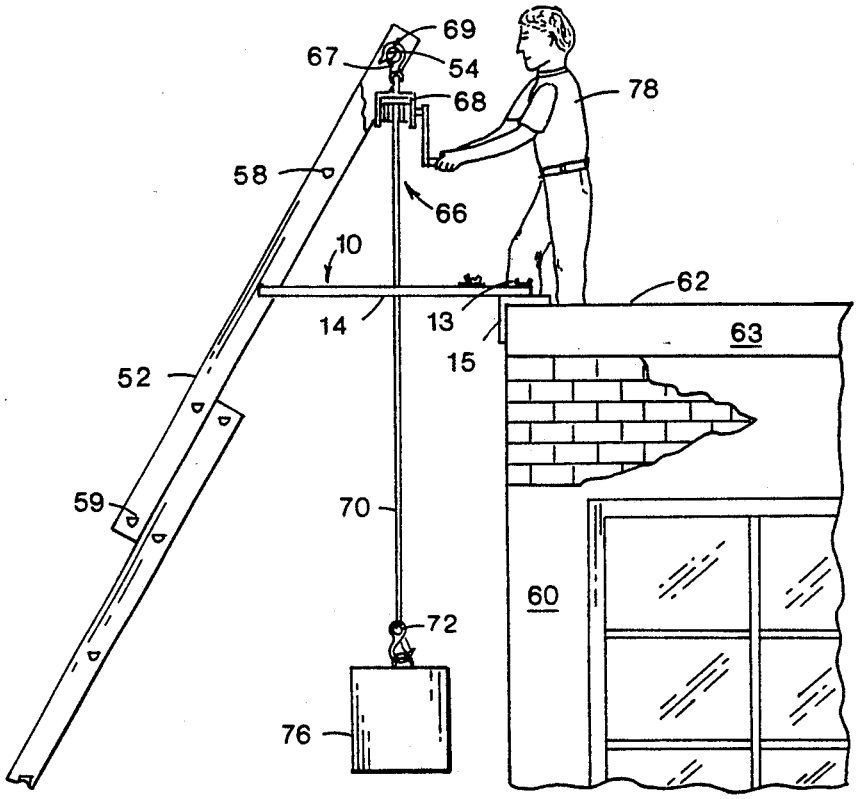
FIG. 3 is a side-view, partial cutaway illustration of the ladder support of the present invention and depicts the ladder support supporting a ladder against a flat-roofed building.

In FIG. 3, the ladder support 10 of the present invention is attached to ladder 52, ladder support 10 being secured to the ladder 52 by being inserted into a "D" rung-shaped cavity 58. Such half-moon shaped cavities are typical of many conventional ladders. However, the teachings of the present invention are applicable to ladders having rung cavities of other shapes. Each cavity 58 of each ladder rung 54 has a flat top portion 59 which corresponds to the flat top portion of a ladder rung upon which an individual stands. The ladder support 10 in FIG. 3 is supporting the ladder 52 against the building 60. Roof-contact region 13 of building contact member 12 contacts the flat roof 62 of the building 60 and wall-contact member 15 contacts the exterior wall 63 of building 60. A winch assembly 66 is attached to the ladder 52 with the winch assembly comprising a winch 68, a cable 70 and a load attachment 72 (shown as a hook) which is attached to a load 76 (e.g. an air conditioning compressor). A man 78 is cranking the winch 68 to lift the load 76 to the flat roof 62 of building 60.

The winch 68 is connected to a ladder rung 54 by means of a ladder hook 69 which is provided with a safety latch 67. In testing the ladder support of the present invention, a Fulton Model #K1051 work winch rated at 1000 lbs. was connected to 40 feet of 5/32" 7×19 galvanized aircraft cable with a test strength of 2,800 lbs. A load of 360 pounds was safely lifted to roof level. In operation, a load should not exceed the ladder manufacturer's load rating for a given ladder rung of the ladder. As a further precaution, a solid metal bar or rung support perhaps 20" long or so (a rung support is not shown in drawings) should be inserted inside the rung to which the winch 68 is to be connected. The metal bar or rung support is an added safety measure to prevent rung failure. Bolts can be inserted at each end of the rung support to prevent the rung support from slipping out of the cavity of the rung.

Figure 4:
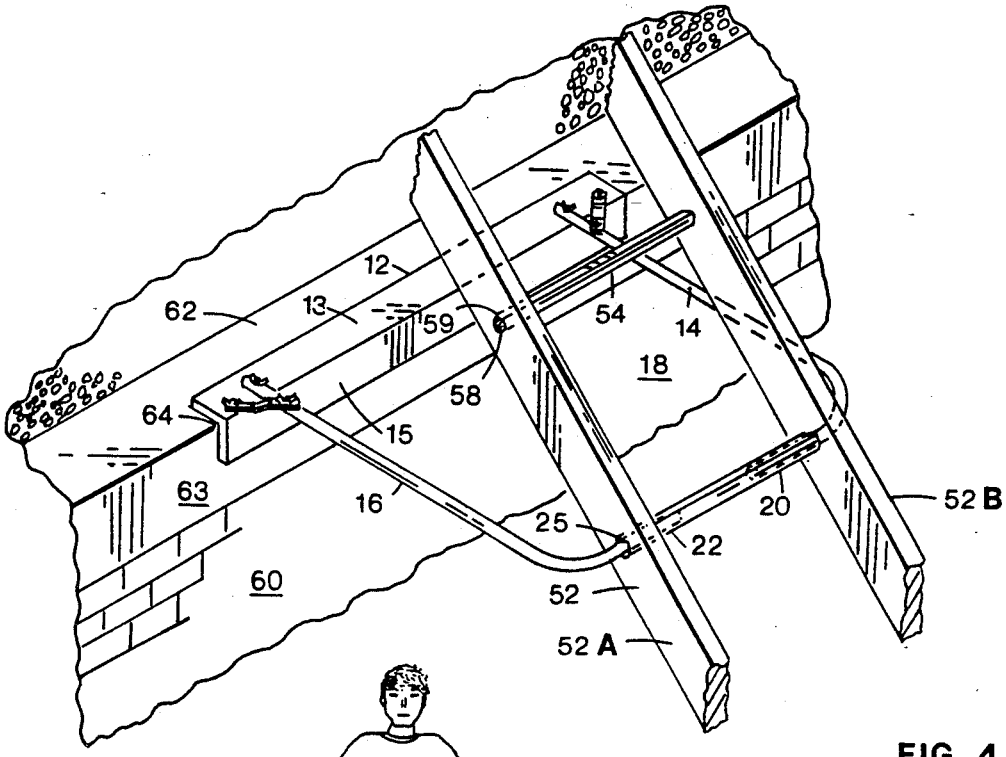
FIG. 4 is a close-up, perspective illustration of the ladder support of the present invention, with the building contact member of the ladder support contacting the roof and wall of a building.

In FIG. 4, a close-up perspective illustration has ladder 52 supported against building 60, with one side of the ladder being indicated by numeral 52A and the other side of the ladder being indicated by numeral 52B. The roof-contact member 13 of ladder support 10 makes contact with the roof 62 and the wall-contact member 15 makes contact with the exterior wall 63 of the building 60. The building contact member 12 covers the edge 64 of the roof 62. In the prototype of the present invention, the roof-contact member 13 was designed to extend some four inches onto roof 62 to achieve a flush pressure contact connection with the flat roof 62, and the wall-contact member was designed to extend some four inches down the wall 63 of the building 60 along a four foot span of the roof 62 and wall 63 to achieve a flush pressure contact connection with the wall 63. In the prototype of the present invention, the ladder support extends approximately forty inches from the edge of the roof 64 to the cavity 58 of ladder rung 54 to which it is connected. FIG. 4 further illustrates how the insertable ends 20 and 22 of insertable connecting members 14 and 16, respectively, are secured and positioned inside the ladder rung 54. Insertable end 20 is horizontally inserted into cavity 58 of ladder rung 54 from side 52B and insertable end 22 is horizontally inserted into cavity 58 of ladder rung 54 from side 52B of ladder 52.

Figure 5:
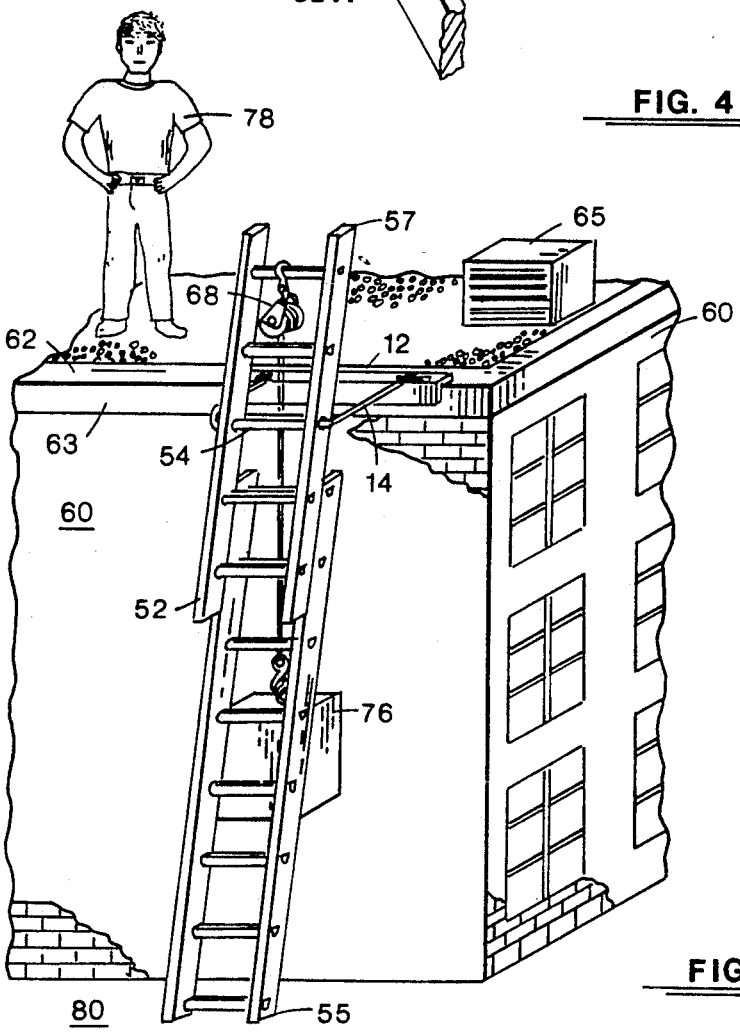
FIG. 5 is a perspective illustration of the ladder support of the present invention supporting a ladder against a flat-roofed building, a winch is attached to the ladder which is supporting a load to illustrate how the ladder support of the present invention can be operated.

In FIG. 5, a ladder 52 positioned upon the ground 80 and supported against the building 60 by the ladder support 10 of the present invention is provided with a winch 68 for hoisting a load 76 (e.g., an air conditioning compressor) to the roof top 62 upon which is located an air conditioning unit 65.

In operation a single individual equipped with a conventional ladder, winch assembly, and the ladder support 10 of the present invention can easily attach the ladder support 10 and winch to a ladder so as to be able to lift heavy loads in a safe manner to a building rooftop. A first step when using the ladder support 10 of the present invention is to place an extension ladder on the solid ground 80 or surface adjacent to a building 60 (see FIG. 5). The ladder should be extended so that the top of the ladder 57 is approximately four feet higher than the roof edge.

The ladder angle should be maintained according to the ladder manufacturer's specifications which generally appear on the ladder label. The feet of the ladder should be level on the ground 80 or solid surface adjacent the building 60. If any wind is present, the ladder should be securely tied to the building with rope to prevent the ladder from being blown over. As a next step, the bottom of the ladder 55 (see FIG. 5) should be moved about 36" further away from the building wall 63. The load 76 to be lifted should be centered at the middle of the ladder, i.e., between the respective sides of the ladder 52 and close to the wall 63. The load attachment 72 (e.g., winch hook or clevis) should be attached to the load 76 in a secure manner so the load 76 will not shift when lifted. Enough cable should be pulled from the winch 68 to go to the top rung of the ladder where the winch 68 is to be secured.

Next, the ladder support 10 of the present invention must be carried to the flat roof 62 of the building 60 by an individual climbing the ladder 52. The winch 68 must be carried to the roof 62 as well. Once on the roof, the winch is secured to the top rung of the ladder at the center of the top rung.

The ladder support should be fully assembled when carried to the flat roof 62 for purposes of saving time. To secure the ladder support 10 to the ladder 52, insertable end 22 is inserted into rung cavity 58, rung cavity 58 being located on side 52A of ladder 52 (see FIG. 4). The bolt, washer, and wingnut (not shown) are disconnected from bolted connection point 42 to allow insertable end 20 to be inserted inside rung cavity 58 at the other side 52B of ladder 52. The bolt, washer, and wingnut are then connected at connection point 42 so that the ladder support 10 is securely connected to the ladder 52.

Once the ladder support 10 is installed to the ladder 52, the building contact member 12 can be lifted, pushed and positioned so that the roof contact region 13 of building contact member 12 is in contact with the flat roof 62 and the wall contact region 15 of contact member 12 is in contact with the exterior wall 63 of building 60. It is important that the insertable connecting members 14 and 16 be substantially level with the top of flat roof 62 and be substantially parallel to the ground 80. The building contact member 12 should now be securely connected to the building 60 with the roof contact region 13 and the wall contact region 15 of contact member 12 meeting at edge 64 of building 60.

The load 76 should have a minimum clearance of 6" from the ladder 52, building 60 and insertable connecting members 14 and 16 of the ladder support 10. With the load 76 attached to the cable 70, crank the winch 66 until the load is to roof top level. As the load is lifted off the ground, forces acting upon the roof contact region 13 further press the roof contact region 13 into secure contact with the flat roof 62. Once the load is above the roof level, gently pull the load 76 toward the building while letting the cable 70 down until the load is safely onto the flat roof 62 of building 60.

The maximum load rating of the ladder being used should not be exceeded. The ladder support of the present invention can be used to safely and efficiently lift loads of 300 pounds or more. In operation, the ladder and ladder support 10 should not be set up over any doorways or windows where it would be possible for a load to damage or cause injury to persons or property.

The prototype of the present invention used connecting members 14 and 16 (see FIG. 2) which had a 1" outer diameter. Examples of ladders currently on the market with which the prototype of the present invention could be used include: the Keller #5124 Light Duty Ladder which is 18" wide and has a "D" type rung having a 1 and ⅛ inch bore; the Keller #3224 Light Duty Ladder which is 16" wide and has a "D" type rung having a 1 and ⅛ inch bore; the Keller #3532 Medium Duty Ladder which is 17" wide and has a "D" type rung having a 1 and ⅛ inch bore; the Cuprum #405-28 Medium Duty Ladder which is 15" wide and has a "D" type rung having a 1 and ⅛ inch bore; the Louisville #AE1224 Heavy Duty 300# Aluminum Ladder which is 16 and ¼ inches wide and has a "D" type rung with a 1 and ⅛ inch bore; the Louisville #FE3224 Heavy Duty 300# Fiberglass ladder which is 16 and ¼ inches wide and has a "D" type rung having a 1 and ⅛ inch bore; and the Werner Medium Duty ladder which is 16" inches wide and has a "D" type rung having a 1 and 3/16" bore.

The teachings of the present invention can be utilized to make a ladder support 10 which has insertable connecting members 14 and 16 of any given diameter to accommodate ladders having an assortment of rung bores. Substitute materials other than those mentioned above made be utilized, however, materials should be selected on the basis of strength and general durability.

The present invention provides an affordable and easily installed ladder support which will make the jobs of many technical and service personnel both easier and safer.

The above description of the present invention is intended to be illustrative and non-limiting. Many modifications and variations of the present invention are possible in light of the above teachings. Therefore, it is understood that within the scope of the appended claims, the invention may be practiced otherwise than as specifically described therein.

What is claimed is:

1. A ladder support for use on flat-roofed buildings in conjunction with a ladder having a ladder rung provided with a ladder rung cavity which is horizontally accessible from either side of the ladder, said ladder support comprising:

a building contact member for making contact with a flat roof and a wall proximate to a roof edge;

a first insertable connecting member connected to said building contact member, said first insertable connecting member having an integrally connected bending elbow which forms an insertable end for purposes of achieving a horizontal insertable connection with the ladder rung cavity of the ladder rung on one side of the ladder;

a second insertable connecting member connected to said building contact member in such a manner that a hoisting space is created between said first insertable connecting member and said second insertable connecting member, said second insertable connecting member having an integrally connected bending elbow which forms an insertable end for purposes of achieving a horizontal insertable connection with the ladder rung cavity of the ladder rung on the other side of the ladder; and wherein said first insertable connecting member has an insertable end inserted into the ladder rung cavity on one side of the ladder and said second insertable connecting member has an insertable end inserted into the ladder rung cavity on the other side of the ladder.

2. A ladder support according to claim 1, wherein:

said building contact member is comprised of a roof-contact region and a wall-contact region which form a right angle to achieve a flush pressure contact connection with a portion of a wall and a portion of a flat roof at the roof edge of a flat roofed building, said wall contact region being connected in perpendicular relation to a connecting end of said first insertable connecting member and to a connecting end of said second insertable connecting member.

3. A ladder support according to claim 1, further comprising:

a first stop bolt connected to the insertable end of said first insertable member;

a second stop bolt connected to the insertable end of said second insertable member; and wherein said first stop bolt is for preventing movement of said first insertable connecting member in the direction toward said second insertable connecting member and said second stop bolt is for preventing movement of said second insertable member in the direction toward said first insertable connecting member when said ladder support is connected to a ladder.

4. A ladder support according to claim 1, further comprising:

a first bar support connected to a connecting end of said first insertable connecting member, and said first bar support being connected to a first lateral end of said building contact member; and a second bar support connectable to a connecting end of said second insertable connecting member, and said second bar support being connectable to a second lateral end of said building contact member.

5. A ladder support according to claim 4, further comprising:

means for bolting said first insertable connecting member to said building contact member and to said first bar support.

6. A ladder support assembly according to claim 5, for bolting said first insertable connecting member to said building contact member to and said second bar support.

7. A ladder support assembly for use on flat-roofed buildings, comprising:

a building contact member for making contact with a flat roof and a wall proximate to a roof edge;

a first insertable connecting member connected to said building contact member;

a second insertable connecting member connected to said building contact member in such a manner that a hoisting space is created between said first insertable member and said second insertable connecting member;

a ladder having a plurality of tubular rungs having cavities which are shaped to accommodate and secure an insertable end of said first insertable connecting member and an insertable end of said second insertable connecting member; and wherein said insertable end of said first insertable connecting member and said insertable end of said second insertable connecting member are inserted into a cavity of a tubular rung of said plurality of tubular rungs so as to connect said insertable ends to the tubular rung such that when said building contact member is in contact with a flat roof of a building said first insertable connecting member and said second insertable connecting member are substantially parallel to the ground upon which said ladder is based.

8. A ladder support assembly according to claim 7, further comprising:

a winch assembly connectable to any one of the plurality of rungs of said ladder.

9. A ladder support assembly according to claim 8, wherein said winch assembly comprises:

a winch connected to a ladder hook equipped with a safety latch for attaching said winch to any one of the plurality of rungs of said ladder;

a cable connected to said winch; and means for attaching a load to said cable.

10. A ladder support according to claim 7, wherein:

each tubular rung of the plurality of tubular rungs of said ladder has a cavity whose cross-sectional side view reveals a shape to accommodate and secure the insertable end of said first insertable connecting member and the insertable end of said second insertable connecting member.

11. A ladder support according to claim 10, wherein said cavity has a "D" type shape.

12. A ladder support assembly to enable a heavy load to be lifted to a flat roof of a building by a single individual, said ladder support assembly comprising:

a ladder having a plurality of tubular rungs with each rung of said plurality of rungs forming a cavity which is horizontally accessible from either side of said ladder;

a building contact member having a planar roof-contact region for realizing a flush pressure contact connection with the flat roof of the building, said building contact member having a planar wall-contact region for realizing a flush pressure-contact connection with a wall of said building, said planar roof-contact region and said planar wall-contact region connecting at right angles to cover an edge of the flat roof,;

a first insertable connecting member and a second insertable connecting member in mirror image relation to one another and forming a hoisting space therebetween, said first insertable connecting member connected to said planar roof-contact region at one lateral end of the building contact member and said second insertable connecting member connected to said planar roof-contact region at the other lateral end of said building contact member, said first connecting member having an insertable end inserted from one side of the ladder into a cavity formed by one tubular rung of said plurality of tubular rungs, and said second connecting member having an insertable end inserted from the other side of the ladder into the cavity formed by the one tubular rung of said plurality of rungs; and a winch assembly connected to a rung of said plurality of rungs which is positioned above the flat roof of the building such that the heavy load can be hoisted to the flat roof of the building through the hoisting space.

13. A ladder support assembly according to claim 12, wherein said planar wall-contact region and said planar roof-contact region of said building contact member are integrally connected.

14. A ladder support assembly according to claim 12, further comprising:

a first bar support connected to the planar roof-contact region of said building contact member and connected to said first insertable connecting member;

a second bar support for connecting to said planar roof-contact region of said building contact member and connected to said second insertable connecting member.

15. A ladder support assembly according to claim 14, wherein said first bar support, said first insertable connecting member and said building contact member are connected by bolts.

16. A ladder support assembly according to claim 15, wherein said second bar support, said second insertable connecting member and said building contact member are connected by bolts.

17. A ladder support assembly according to claim 12, where:

said insertable end of said first insertable connecting member is formed by a bending elbow which is integral to said first insertable connecting member, and said insertable end of said second insertable connecting member is formed by a bending elbow which is integral to said second connecting member.

18. A ladder support assembly according to claim 12, wherein the ladder rung to which said winch assembly is connected is positioned above the flat roof of the building such that a heavy load can be hoisted to the flat roof of the building through the hoisting space.

* * * * *